US007033200B2

(12) United States Patent
Cui et al.

(10) Patent No.: US 7,033,200 B2
(45) Date of Patent: Apr. 25, 2006

(54) ZERO INSERTION FORCE ELECTRICAL CONNECTOR WITH RELIABLE ACTUATION MEMBER

(75) Inventors: Linjiang Cui, Kunsan (CN); Wei Yu, Kunsan (CN); XueBin Zhang, Kunsan (CN)

(73) Assignee: Hon Hai Precision Ind. Co. Ltd., Taipei Hsien (TW)

( * ) Notice: Subject to any disclaimer, the term of this patent is extended or adjusted under 35 U.S.C. 154(b) by 0 days.

(21) Appl. No.: 10/988,107

(22) Filed: Nov. 12, 2004

(65) Prior Publication Data

US 2005/0101175 A1 May 12, 2005

(30) Foreign Application Priority Data

Nov. 11, 2003 (TW) ..... 92219944 U

(51) Int. Cl.
*H01R 4/50* (2006.01)

(52) U.S. Cl. ..... 439/342

(58) Field of Classification Search ..... 439/70, 439/71, 259, 261–266, 268–270, 342
See application file for complete search history.

(56) References Cited

U.S. PATENT DOCUMENTS

| | | | | |
|---|---|---|---|---|
| 6,146,178 | A | 11/2000 | Walkup et al. | |
| 6,280,223 | B1 | 8/2001 | Lin | |
| 6,419,514 | B1 | 7/2002 | Yu | |
| 6,530,797 | B1 | 3/2003 | Liao et al. | |
| 6,893,283 | B1 * | 5/2005 | Yu | 439/342 |

* cited by examiner

*Primary Examiner*—Khiem Nguyen
(74) *Attorney, Agent, or Firm*—Wei Te Chung

(57) ABSTRACT

A zero insertion force (ZIF) electrical connector (1) includes a base (10), a cover (20) mounted on the base, and an actuation member (3) for actuating the cover to slide along the base. The base defines a chamber in an end thereof, a hole (123) in the same end. The actuation member is received in the chamber, including a driving member (30), a spring-holding shaft (34) inserted into the hole and a spring (32) attached around the spring-holding shaft. An end of the spring securely engages the spring-holding shaft and an opposite end of the spring abuts against the operating lever. The spring is compressed once the operating lever is moved in a halfway from a locking position to an unlocking position of the actuation member, so as to resume itself to urge the actuation member toward the unlocking position automatically and completely.

17 Claims, 4 Drawing Sheets

ZERO INSERTION FORCE ELECTRICAL CONNECTOR WITH RELIABLE ACTUATION MEMBER

BACKGROUND OF THE INVENTION

1. Field of the Invention

The present invention relates to a zero insertion force (ZIF) electrical connector, and particularly to a ZIF electrical connector for electrically connecting an electronic package such as a central processing unit (CPU) with a circuit substrate such as a printed circuit board (PCB). The invention relates to a copending application Ser. No. 10/839,838 filed on May 5, 2004.

2. Description of the Prior Art

Zero insertion force (ZIF) electrical connectors are well known in the computer industry and are used for electrically connecting electronic packages such as central processing units (CPUs) with circuit substrates such as printed circuit boards (PCBs). Pertinent examples of such connectors are disclosed in U.S. Pat. Nos. 6,544,065, 6,533,597, 6,508,659, 6,482,022, 6,406,317 and 6,280,223.

Normally, a conventional ZIF electrical connector comprises a base soldered to and electrically connected with a PCB, a cover slideably mounted on the base and having a CPU attached thereon, and an actuating device for actuating the cover to slide along the base. The CPU has a plurality of leads extending outside a bottom surface thereof and arranged in a rectangular array. The cover has a plurality of through holes arranged corresponding to the leads of the CPU. The base defines a plurality of receiving passageways arranged corresponding to the leads of the CPU, too. Each receiving passageways receives an electrical terminal therein. When the CPU socket is in an open position, the leads of the CPU extend through the corresponding through holes of the cover and are received in the corresponding passageways of the base. The leads of the CPU do not contact the corresponding electrical terminals, thereby the CPU is attached on the CPU socket with zero insertion force. The actuation device comprises an operation lever to facilitate manual handling by a user. When the operation lever is rotated toward and locked in a closed position, the cover is correspondingly driven to slide along the base, and the CPU socket reaches a closed position. The actuation device thus pushes the leads of the CPU into mechanical and electrical engagement with the electrical terminals.

Prior to attachment of the CPU onto the socket, the operation lever may be inadvertently positioned midway between the open position and the closed position. When the CPU is attached to the socket, the leads of the CPU are inserted directly into the electrical terminals of the base. The leads of the CPU and the terminals in the base are liable to be damaged, in which case the electrical engagements between the leads of the CPU and the corresponding electrical terminals may be impaired.

Hence, an electrical connector having an improved actuation device is desired to overcome the disadvantages of the related art.

SUMMARY OF THE INVENTION

Accordingly, it is an object of the present invention to provide a zero insertion force (ZIF) electrical connector having a actuation device that can automatically position itself to an open position prior to attachment of the CPU onto the connector.

To achieve the above object, a ZIF electrical connector in accordance with a preferred embodiment of the present invention comprises an insulating base mounted onto a circuit substrate such as a printed circuit board (PCB), a cover movably mounted onto the base, and an actuation member located between the cover and the base to move the cover with respect to the base. The base defines a T-shaped chamber in an end thereof, a bind hole in the same end and parallel with the longitudinal direction of the base, and a baffle at the end adjacent the chamber. The cover defines an opening in an end thereof. The actuation member comprises a driving member located in the chamber, a spring-holding shaft received in the bind hole of the base, a spring attached around an end of the spring-holding shaft. The driving member has a driving shaft and an operating lever engaging with the driving shaft at an end thereof. The driving shaft comprises a cam at an opposite end thereof, the cam engaging in the opening of the cover to move the cover when the driving shaft rotating. An end of the coil spring securely engages the spring-holding shaft and an opposite end of the spring abuts against the operating lever. Due to structural engagement between the actuation member and the base, said spring is deformed once the operating lever is moved in a halfway from a closed position to an open position of said actuation member, so as to resume itself to urge the actuation member toward said open position completely.

Other objects, advantages and novel features of the present invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
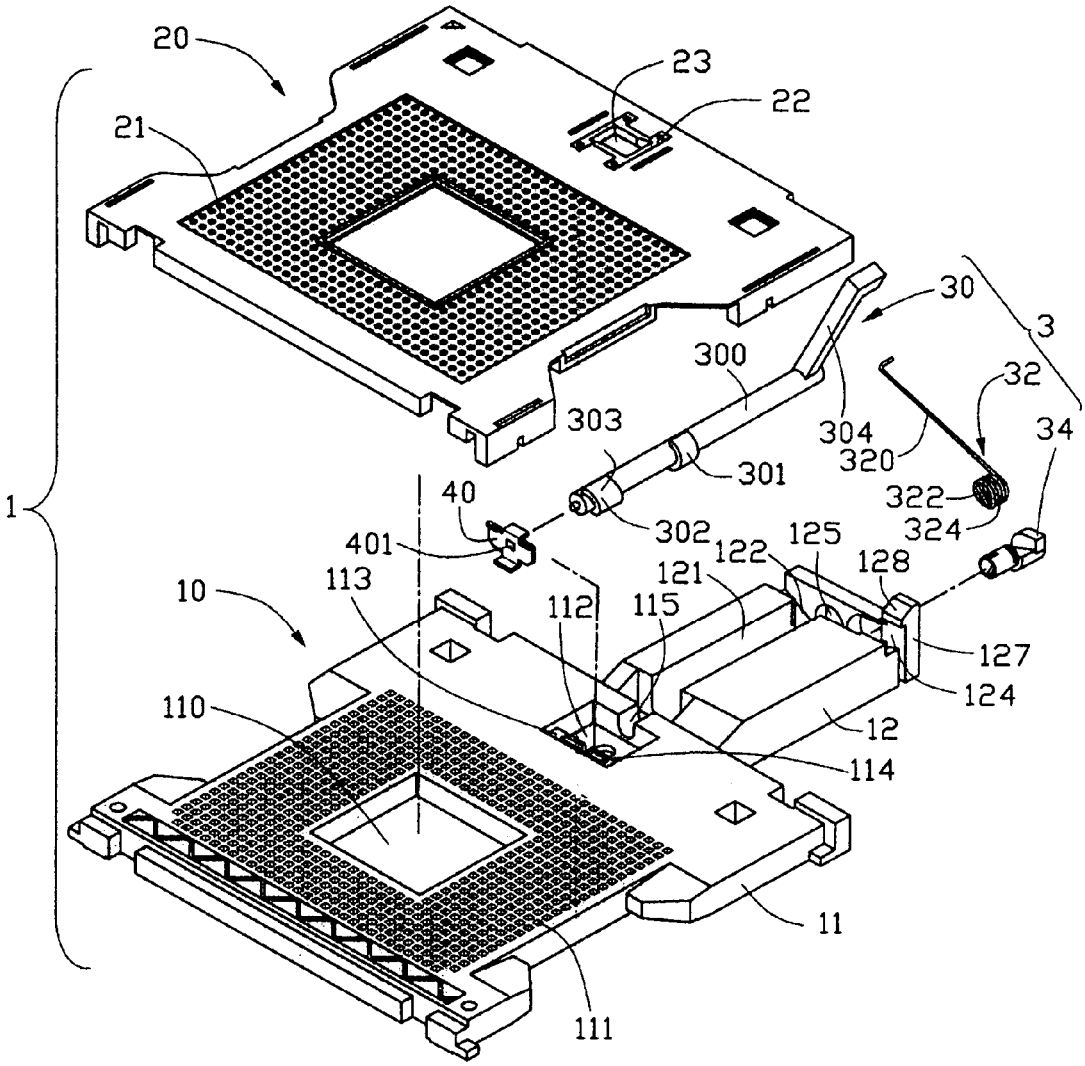
FIG. 1 is an exploded, isometric view of a ZIF electrical connector in accordance with the preferred embodiment of the present invention, wherein the connector comprises an insulating base, a cover and an actuation member.

The present invention provides a zero insertion force (ZIF) electrical connector for electrically connecting an electronic package such as a central processing unit (CPU) with a circuit substrate such as a printed circuit board (PCB). As shown in FIG. 1, the connector 1 comprises an insulating base 10 soldered to and electrically connected with the PCB (not shown), a cover 20 movably mounted onto the base 10 for attaching the CPU (not shown) thereon, and an actuation member 3 assembled between the base 10 and the cover 20 to move the cover 20 with respect to the base 10.

The base 10 comprises a body portion 11, and a head portion 12 extending from a middle portion of an end of the body portion 11. The body portion 11 defined a generally rectangular window 110 in a center portion thereof. A multiplicity of passageways 111 is defined in the body portion 11, the passageways 111 arranged in a rectangular array around the window 110. Each passageway 111 receives an electrical contact (not shown) in a side thereof, and forming a receiving space in opposite side thereof adjacent the contact. A rectangular cavity 112 is defined in a middle of a portion of the body portion 11, the portion between the passageways 111 and the end of the body portion 11. A protrusion 113 extends from the body portion 11 in the cavity 112. An aperture 114 is defined in the protrusion 113, and communicates with the cavity 112. A metal clip 40 is accommodated in the aperture 114. A bore 401 is defined in a middle of the clip 40, and communicates with the cavity 112. A semicircular recess 115 is defined in the middle of the end of the body portion 11, which is in communication with the cavity 112.

The cover 20 has a shape similar to the body portion 11 of the base 10. A multiplicity of passageways 21 is defined in the cover 20, corresponding to the passageways 111 of the base 10. A metal frame 22 is embedded in a middle portion of an end of the cover 20. An opening 23 is defined in a middle of the frame 33, corresponding to the cavity 112 of the base 10.

Figure 2:
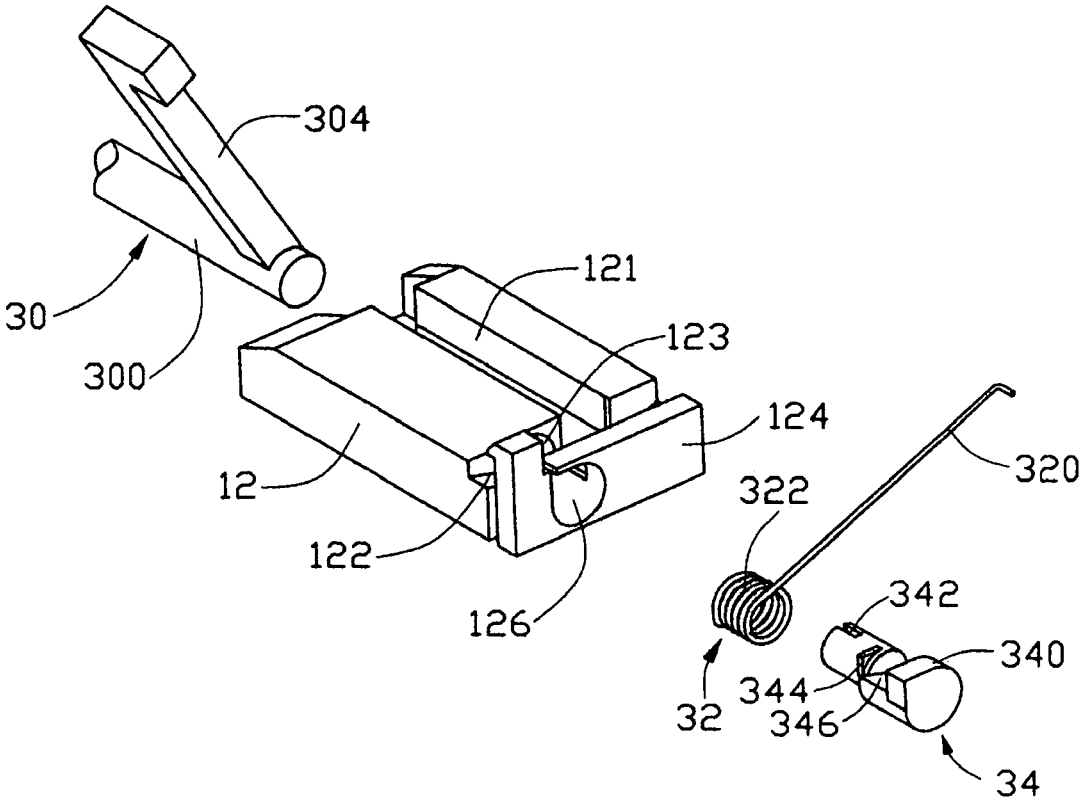
FIG. 2 is an enlarged, exploded view of the actuation member and a part of the base.

A width of the head portion 12 is substantially one third of a width of the body portion 10. The head portion 12 defines a T-shaped chamber (not labeled), and a baffle 124 at a distal end thereof. The chamber comprises a shaft-receiving slot 121 extending in a longitudinal direction of the head portion 12, and a lever-receiving slot 122 perpendicular to the shaft-receiving slot 121. Referring to FIG. 2, there is shown an enlarged view of part of the head portion 12. The lever-receiving slot 122 is disposed in a free end of the head portion 12 adjacent the baffle 124. A first blind hole 123 parallel with the shaft-receiving slot 121 is defined in the free end of the head portion 12. A retention recess 126 is defined in the baffle 124, in alignment with the first blind hole 123. A second blind hole 125 (labeled in FIG. 1) is defined in a middle of the baffle 16, in alignment with the shaft-receiving slot 121. A hook 127 is formed at a side of the baffle 124 with a ramp 128 toward the lever-receiving slot 122.

Referring to FIG. 2 and in conjunction with FIG. 1, the actuation member 3 comprises a driving member 30, a spring 32 and a spring-holding shaft 34. The driving member 30 comprises a driving shaft 300 and an L-shaped operating lever 304 mated with the driving shaft 300 at an end thereof. A pin 303 coaxially extends from another end of the driving shaft 300. A semicircular projecting member 301 is formed partly around a middle portion of the driving shaft 300. A cam 302 is formed partly around the end of the driving shaft 300.

The spring 32 includes a main coil portion 322, a L-shaped first end 320 and a L-shaped second end 324 extending respectively two ends of the main coil portion 322. The L-shaped first end 320 is longer than the L-shaped second end 324. The spring 32 is assembled around the spring-holding shaft 34. The spring-holding shaft 34 includes a protruding cam 340 at an end thereof, a holding notch 342 defined at another end thereof, a block 344 for preventing the movement of the spring 32 to the protruding cam 340, and an oblique recess 346 defined between the block 344 and the cam 340.

In assembly, the spring 32 is firstly assembled around the spring-holding shaft 34. The L-shaped second end 324 of the spring 32 is retained in the holding notch 342. An edge of the block 344 abuts against an end adjacent the L-shaped first end 320 of the main coil portion 322. The spring-holding shaft 34 is received in the first blind hole 123. The L-shaped second end 324 of the spring 32 and the holding notch 342 of the shaft 34 is substantially in the blind hole 123. The L-shaped first end 320 is outside the blind hole 123. The oblique recess 346 is in alignment with the lever-receiving slot 122. The protruding cam 340 is mated with the retention recess 126 referencelly, which cannot rotate any more. The spring 32 and the spring-holding shaft 34 are thus positioned.

The L-shaped operating lever 304 is assembled on the driving shaft 300. The driving shaft 300 is received in the shaft-receiving slot 121. The pin 303 of the driving shaft 300 is inserted into the bore 401 of the metal clip 40. The metal clip 40 is accommodated in the aperture 114 of the protrusion 113. The end adjacent the operating level 304 of the driving shaft 300 engaging in the second blind hole 125 of the baffle 124. Thus, the actuation member 3 is assembled onto the base 10, with the cam 302 in the cavity 112, the L-shaped first end 320 abutting against a face of the operating lever 304. Then, the cover 20 is assembled onto the base 10, with the cam 302 engagingly in the opening 32 of the cover 3.

Figure 3:
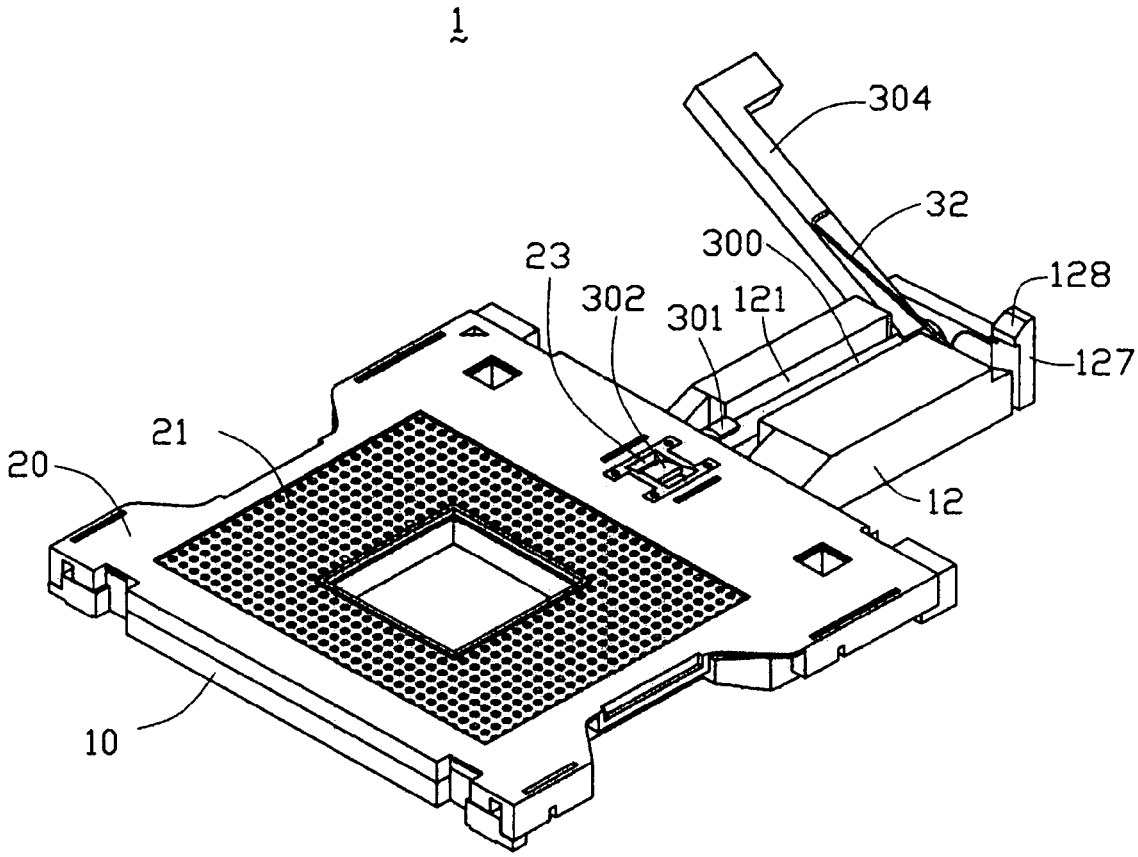
FIG. 3 is an assembled view of the connector of FIG. 1, showing the actuation member oriented at a first position.
Figure 4:
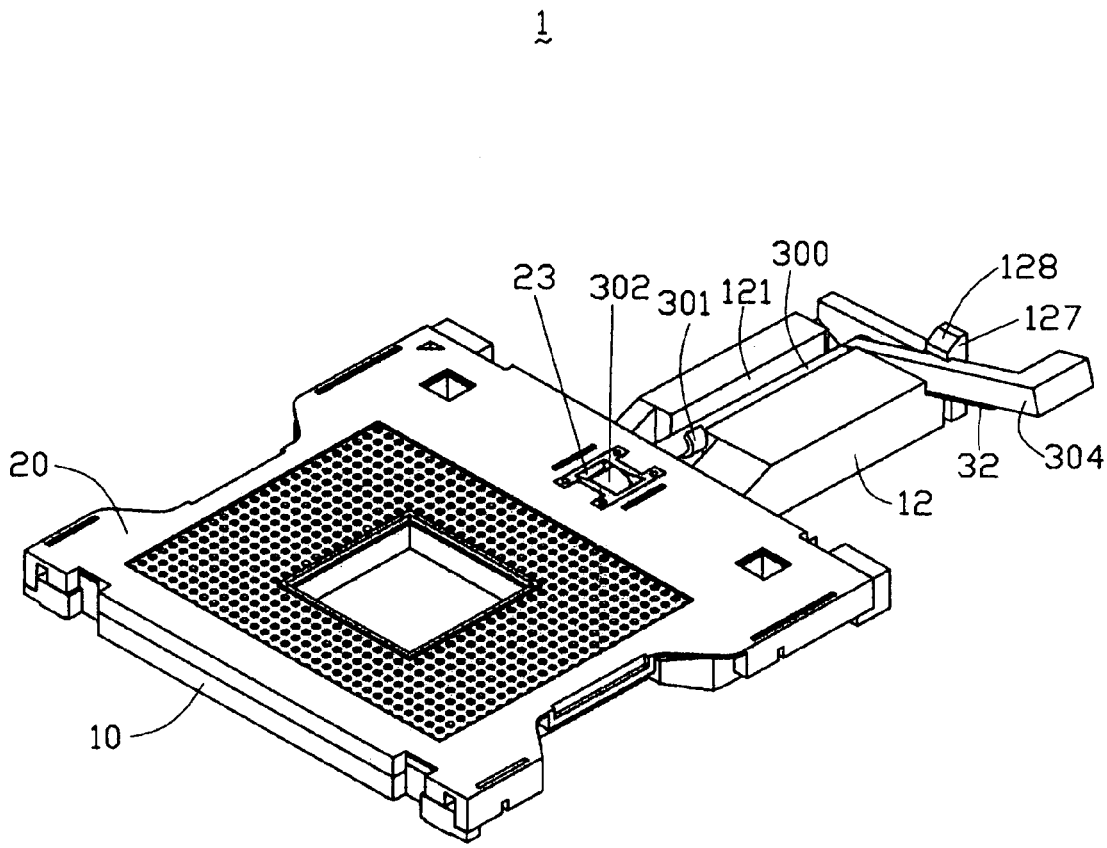
FIG. 4 is similar to FIG. 3, but showing the actuation member oriented at a second position.

Referring to FIGS. 3 and 4, in use, the operating lever 304 is pushed from an open position to a closed position, thereby driving the driving shaft 300 to rotate. When the operating lever 304 is oriented at the open position, the passageways 21 of the cover 20 are located over corresponding receiving spaces of the base 10. Leads (not shown) of the CPU can be inserted through the passages 21 of the cover 20 into the receiving spaces of the base 10 with ZIF. Then the operating lever 304 is pushed to the closed position. Edges of the cam 302 engage with inner edges of the frame 22 of the cover 20 to move the cover 20 with respect to the base 10. The cover 20 pushes the leads of the CPU from corresponding receiving space into corresponding contacts. The hook 127 of the head portion 12 catches the operating lever 304, thereby positioning the operating lever 304 at the closed position. The connector 1 thus connects electrically the CPU with the PCB.

In above-mentioned operation of the operating lever 304, the spring 32 exerts a force on the operating lever 304. When the operating lever 304 is rotated from the closed position to the middle of the baffle 124, the main coil portion 322 is compressed all the time. When the operating lever 304 continues to be rotated toward the open position, the main coil portion 322 of the spring 32 is released gradually, and providing a force for the operating lever 304. The force assists in driving the operating lever 304 to rotate the open position. Therefore, when rotating from the middle portion of the baffle 124 toward the open position, the operating lever 304 can automatically rotate to the open position completely under compression of the spring 32, even if a force providing by an operator is insufficient. Consequently, the leads of the CPU are unlikely to interfere with the contacts of the connector 1, the CPU can reliably be assembled/detached onto/from the connector 1 with ZIF.

From the foregoing it will be recognized that the principles of the invention may be employed in various arrangements to obtain the features, advantages and benefits described above. It is to be understood, therefore, that even though numerous characteristics and advantages of the invention have been set forth together with details of the structure and function of the invention, this disclosure is to be considered as illustrative only. Various changes and modifications may be made in detail, especially in matters of size, shape and arrangements of parts, without departing from the spirit and scope of the invention as defined by the appended claims.

What is claimed is:

1. A zero insertion force (ZIF) electrical connector comprising:

a base defining a plurality of passageways therethrough, a chamber in an end thereof, a hole in the same end;

a cover defining a plurality of passages therethrough corresponding to the passageways of the base, and an opening in an end thereof; and an actuation member located between the cover and the base for driving the cover to move between an open position and a closed position, comprising:

a driving member located in the chamber of the base, the driving member having a driving shaft and an operating lever engaging with the driving shaft at an end thereof, the driving shaft having a cam at an opposite end thereof, the cam engaging in the opening of the cover;

a spring-holding shaft received in the hole of the base;

a spring attached around the spring-holding shaft, an end of the spring securely engages the spring-holding shaft and an opposite end of the spring abuts against the operating lever.

2. The ZIF electrical connector as claimed in claim 1, wherein the chamber comprises a shaft-receiving slot extending in a longitudinal direction of the base, and a lever-receiving slot perpendicular to the shaft-receiving slot.

3. The ZIF electrical connector as claimed in claim 1, wherein the base further defines a baffle at the end adjacent the chamber.

4. The ZIF electrical connector as claimed in claim 3, wherein the baffle forms a retention recess in alignment with the hole, the spring-holding shaft comprising a protrusion at an end thereof mated with the retention recess of the baffle.

5. The ZIF electrical connector as claimed in claim 3, wherein the base forms a hook at a lateral side of the baffle thereof, the hook securely engaging with the operating lever.

6. The ZIF electrical connector as claimed in claim 2, wherein the spring includes a main coil portion, a first end and a second end, the second end being longer than the first one and being outside the bind hole of the base, and abutting against the operating lever.

7. The ZIF electrical connector as claimed in claim 6, wherein the spring-holding shaft having a block, an end of the main coil portion of the spring abutting against an edge of the block.

8. The ZIF electrical connector as claimed in claim 7, wherein the spring-holding shaft having a notch at another end thereof for engaging with the first end of the spring securely.

9. The ZIF electrical connector as claimed in claim 8, wherein the spring-holding shaft further has an oblique recess between the block and the protruding cam, which is in alignment with the level-receiving slot.

10. The ZIF electrical connector as claimed in claim 3, wherein a hole is defined in a middle portion of the baffle of the base, and an end adjacent the operating level of the driving shaft engaging in the hole of the baffle.

11. The ZIF electrical connector as claimed in claim 10, wherein a generally rectangular cavity is defined in the base, the cavity in communication with the opening of the cover when the cover attached onto the base, a protrusion extending from the base in the cavity, and an aperture defined in the protrusion in communication with the cavity, a metal clip accommodated in the aperture, and a bore defined in a middle of the clip.

12. The ZIF electrical connector as claimed in claim 11, wherein a pin extends from an end of the driving shaft adjacent the cam thereof, the pin engaging in the bore of the clip.

13. The ZIF electrical connector as claimed in claim 1, wherein a metal frame is embedded in the end of the cover, and the opening of the cover is defined in a middle portion of the metal frame.

14. A zero insertion force (ZIF) electrical connector comprising:

a base with a plurality of contacts therein, a cover mounted on the base and slidable relative to the base along a front-to back direction;

an actuation member located between the cover and the base for driving the cover to move between an open position and a closed position, including:

a driving member having means for actuating said cover to move along said front-to back direction, the driving member having a driving shaft and an operating lever engaging with the driving shaft at an end thereof;

a spring-holding shaft inserted into the base in the front-to back direction; and a spring attached around the spring-holding shaft, an end of the spring securely engages the spring-holding shaft and an opposite end of the spring abuts against the operating lever;

said spring is compressed once the operating lever is moved in a halfway from the closed position to the open position of said actuation member, the operating lever reverting to the open position due to an elastic deformation of the spring, and the cover moved to the open position automatically.

15. A zero insertion force (ZIF) electrical connector comprising:

a base defining a plurality of passageways therethrough and a baffle at one end;

a cover defining a plurality of passages therethrough corresponding to the passageways of the base; and an actuation member located between the cover and the base for driving the cover to move between an open position and a closed position, comprising:

a driving member having a rotatable driving shaft with a cam thereof to actuate the cover to move accordingly and an operation lever linked to said driving shaft and adapted to be latchably seated upon baffle; and a torsion spring fixedly disposed in the base except one end arm abutting against the operating lever; wherein said one end arm is essentially located between said lever and said baffle when said lever is located on the baffle, and a torsion axis defined by said torsion is offset from a pivotal axis of said driving shaft.

16. The connector as claimed in claim 15, wherein said torsion axis is parallel to said pivotal axis.

17. The connector as claimed in claim 15, wherein said torsion axis is closer to said baffle than said pivotal axis in a direction perpendicular to both said torsion axis and said pivotal axis.

* * * * *